United States Patent [19]

Neckerman et al.

[11] Patent Number: 4,752,972

[45] Date of Patent: Jun. 28, 1988

[54] GARMENT CUFF

[75] Inventors: William G. Neckerman, Pendleton; Wing Y. T. Lau, Seneca, both of S.C.

[73] Assignee: The Kendall Company, Boston, Mass.

[21] Appl. No.: 11,079

[22] Filed: Feb. 5, 1987

[51] Int. Cl.[4] ..... A41B 7/00

[52] U.S. Cl. ..... 2/123; 66/172 E; 2/DIG. 7

[58] Field of Search ..... 2/59, 60, 114, 115, 2/123, 124, DIG. 7; 66/172 E, 171, 173, 176; 128/132 D

[56] References Cited

U.S. PATENT DOCUMENTS

| | | | |
|---|---|---|---|
| 1,116,521 | 11/1914 | Walsh | 2/59 |
| 2,763,146 | 9/1956 | Minton | 66/172 R |
| 2,853,865 | 9/1958 | McDonough | 66/173 |
| 3,868,728 | 3/1975 | Krzewinski | 2/114 |
| 4,389,734 | 1/1983 | Franz et al. | 2/60 X |
| 4,630,455 | 12/1986 | Lingenfelter | 66/172 E X |

*Primary Examiner*—Peter Nerbun

*Attorney, Agent, or Firm*—Donald N. Halgren

[57] ABSTRACT

A circular knit garment cuff for use on surgical gowns comprised of a two ply front section, a single ply middle section, and a two ply back section. The front section is knit using two stretchable yarns. The middle section is knit using one stretchable yarn and the back section of the garment cuff is knit using one stretchable yarn. The front section, middle section and back section of the garment cuff are knit together in one continuous knitting step so as to form a single integral garment cuff. The back section of the cuff may then be secured to garment material.

1 Claim, 4 Drawing Sheets

GARMENT CUFF

BACKGROUND OF THE INVENTION

1. Field of the Invention

This invention relates to a knit cuff for use on garments more particularly surgical gowns.

2. Prior Art

Traditional sleeve and ankle cuffs are made from narrow knitted tube fabric, cut to twice the cuff length and then folded back upon itself to form a finished cuff ready for sewing onto a garment. These cuffs are usually 1×1 or 2×2 spun yarn rib construction so the cuff has an inherent amount of stretchability so as to go over the hand or a foot.

Problems with traditional cuffs are that they often do not have enough recovery to form good fit properties after stretching over the hand or foot. They also present a problem to sewing machine operators because the two-layer open end of the folded cuff is difficult to attach to garments without considerable trim waste and loose debris. This is especially critical in the case of cuffed surgical gowns where imperfect attachment could lead to non-sterile conditions. This condition is unacceptable to the surgeons or other hospital personnel.

Thus, there is a present need to provide a cuff for garments that would be economical, have excellent stretch and recovery properties, and to facilitate attachment by sewing while keeping sterile conditions. Prior art has not been able to accomplish the above. On the other hand the present invention has.

SUMMARY OF THE INVENTION

A circular knit garment cuff for use on surgical gowns comprised of a two ply front section, a single ply middle section and a two ply back section. The front section is knit using a textured stretch polyester yarn and a spandex yarn. The middle section is knit using a textured stretch polyester yarn. The back section is knit using a textured stretch polyester yarn. The front section, middle section and back section of the garment cuff are knit together in one continuous knitting step so as to form a single integral garment cuff. The back section of the cuff may then be secured to a garment material.

An object of the present invention is to provide a cuff that is economical to manufacture.

Another object of the present invention is to provide a cuff that does not require cutting or folding to obtain a finished product.

Still another object of the present invention is to provide a cuff that uses lint free yarns so as to provide a sterile atmosphere.

A further object of the present invention is to provide a cuff that has excellent stretch and recovery properties so as to give good stretch and fit properties.

An other object of the present invention is to provide a cuff that will facilitate attachment to garments.

BRIEF DESCRIPTION OF THE DRAWINGS

The objects and advantages of the present invention will become more apparent when viewed in conjunction with the following drawings, in which:

FIG. 8 illustrates a surgical gown with the present invention being attached thereto.

DESCRIPTION OF THE PREFERRED EMBODIMENT

Figure 1:
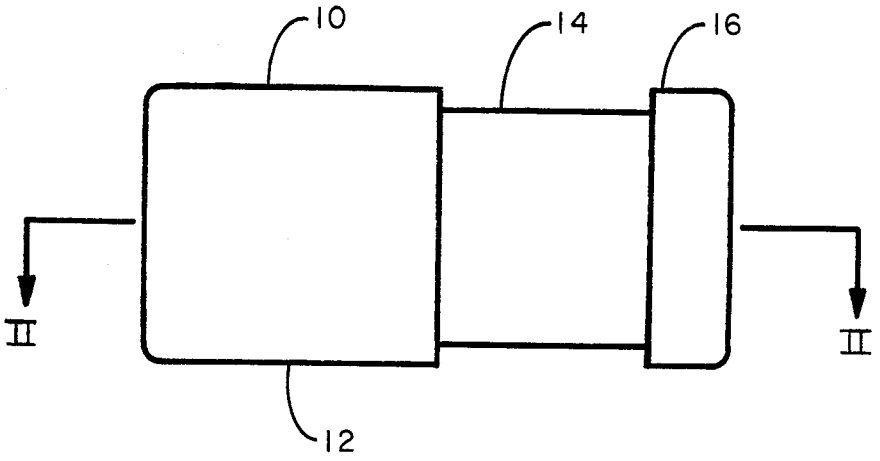
FIG. 1 shows the front, middle, and back section of the present invention.
Figure 2:
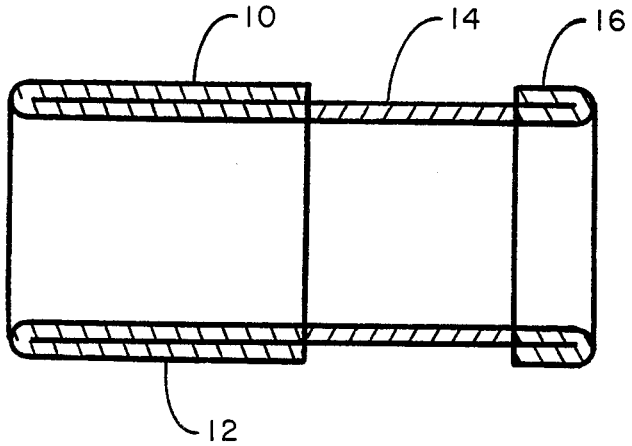
FIG. 2 is a view taken along the line II—II of FIG. 1 to illustrate the different plies of each section.

The present invention, a garment cuff 10, as shown in FIG. 1 has a front section 12, a middle section 14, and a back section 16.

The present invention is primarily used as a cuff on a surgical gown but it should not be limited to one particular garment.

The front section 12, of the garment cuff 10, as illustrated in FIG. 1 is a two ply section. The front section 12 is knit using a textured polyester continuous filament yarn and a spandex continuous filament yarn in conjunction with one another. The textured polyester yarn has a denier of 140, and the denier of the spandex yarn is 125. The spandex used in the front section provides support and permits recovery of the cuff to its original shape once any stretching force has been released.

The middle section 14, of the garment cuff 10, as illustrated in FIG. 1, is a single ply section. The middle section 14 is knit using a textured polyester continuous filament yarn. The textured polyester yarn has a denier of 140.

The back section 16, of the garment 10, as shown in FIG. 1, is a two ply section. The back section is knit using a textured polyester continuous filament yarn. The denier of the textured polyester yarn is 140. The back section is a two ply section so as to provide a substantial material to secure the finished cuff to a garment.

Although the aforementioned yarns are the preferred yarns other yarns, for example nylon or spun yarns may be used with substanially the same results. In addition, other deniers may be used with a slightly different result.

The present invention provides an integral circular knit cuff prepared by either using a womens hosiery machine or sock machine, for example a hoisery machine made by Billie Matee of Italy under the tradename "Zodiac". The hosiery machine is capable of knitting a circular knit in one direction, and is capable through proper programming, to reverse the knitting direction to provide either a single ply fabric or a two ply fabric. It should be noted that the yarn used in the present invention may be either a continuous synthetic filament yarn or a spun yarn. The preferred yarn is a continuous filament because this type of yarn is lint free.

The present invention utilizes the lint free continuous yarn because it is more conducive for use in surgical gowns. Lint free yarns are used because of the lack of foreign matter that is normally associated with yarns. Foreign matter is not wanted in a sterile atmosphere such as is encountered in a hospital setting in which surgical gowns are used. The spandex yarn used in the present invention provides the characteristics of stretch and recovery to the cuff. Stretch and recovery are important because they permit the cuff to stretch over the hand and wrist of the person wearing a surgical gown and also permit the cuff to recover so as to fit snugly onto a persons wrist. This provides a fit that insures a sterile atmosphere to the person wearing the surgical gown. The present invention has an advantage over the prior art. This advantage is due to the continuous knitting, from the beginning to the end of the cuff. Once the present invention cuff has been knit no further steps have to be taken to finish the cuff. The present invention neither has to be cut nor folded to arrive at a finished cuff. This is not so with prior art because the prior art fabric must be cut or trimmed and then folded over onto itself to make a finished cuff. A distinct disadvantage.

The present invention is also more economical to produce than prior art because it takes fewer process steps to end up with a finished material. Additionally, the back section of the present invention permits the cuff to be readily secured to a garment without further preparation. This is due to the fact that the back section once knit has a finished edge which facilitates attachment to a garment. Prior art on the other hand has to take an additional step to trim the cuff to size and then attach the cuff to a garment. This is another disadvantage with the prior art.

To further describe the present invention an example is given.

EXAMPLE

Figure 3:
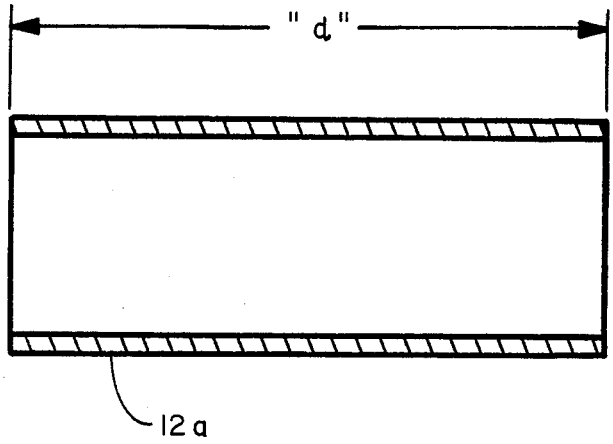
FIG. 3 is a view of the front section before it becomes a two ply material.
Figure 4:
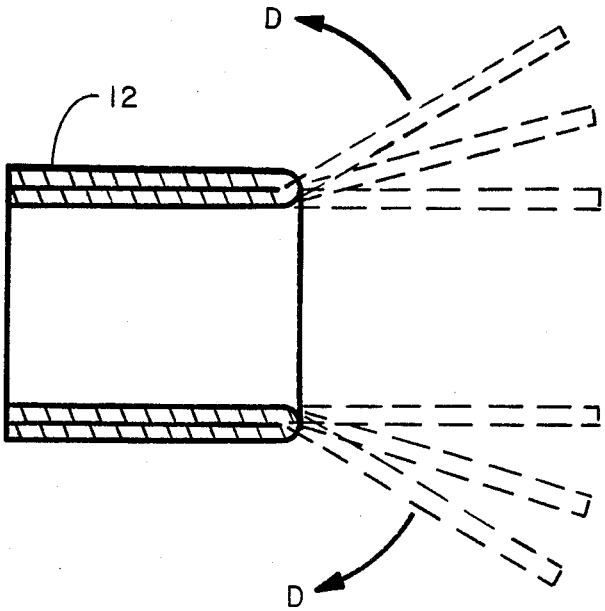
FIG. 4 is a view illustrating the front section after it has become a two ply material.
Figure 5:
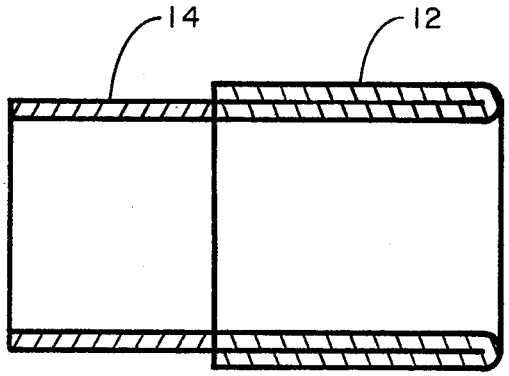
FIG. 5 is a view showing the front section and the middle section.

The present invention is knit on a 4 inch hosiery machine that has approximately 250 needles on its knitting cylinder. A 140 denier textured polyester continuous yarn and a 125 denier spandex continuous yarn are used to knit a two ply front section. To construct the two ply front section of the present invention, the front section is first knit in a single ply 12*a* to a length "d" of about 4 to 5 inches, as illustated in FIG. 3. This is accomplished with the selective knitting needles knitting in a predetermined number of courses. The knitting machine is also programmed to change the needles selection after knitting the single ply fabric, thus returning to its original starting position at the beginning of the front section. Because the knitting machine is programmed to return to the beginning of the front section a portion of the single ply fabric is brought back over itself in direction "D" to the beginning of the fabric, as illustrated in FIG. 4. This forms a two-ply front section 12 approximatley 2 to 2½ inches long. The knitting process continues in its new needles selection, knitting a single ply middle section 14, as shown in FIG. 5. A 140 denier textured polyester continuous yarn is used in a knit-float construction to form the single ply section. The middle section is knit to about 2 inches long.

Figure 6:
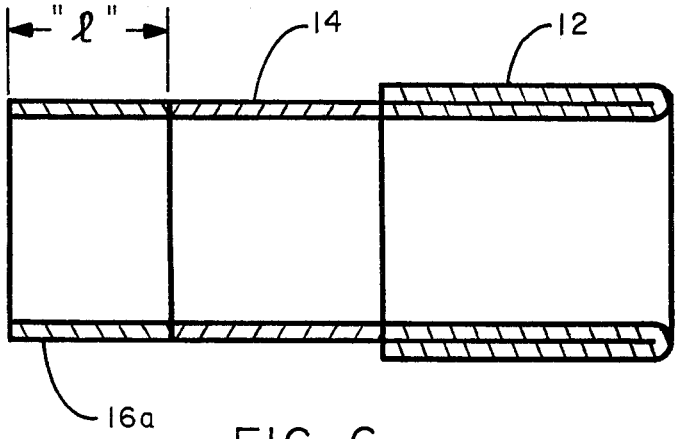
FIG. 6 is a view showing the front section, middle section and the back section before it becomes a two ply material.
Figure 7:
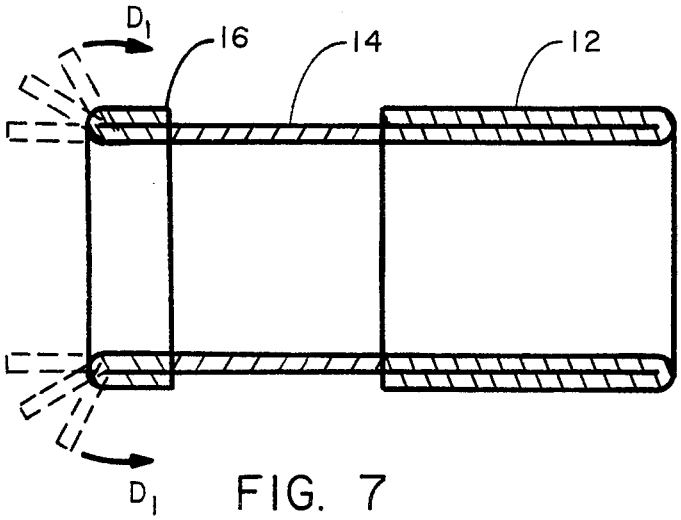
FIG. 7 is a view illustrating the front section, middle section and the back section after it has become a two ply material.

The process then continues to knit a two ply back section. A 140 denier textured polyester continuous filament yarn is used in the back section. To construct the two ply back section of the present invention, the back section is first knit in a single ply 16*a* to a length "1" of about 1 inch, as illustated in FIG. 6. This is accomplished with the changing knitting needles selection as they did in the knitting of the middle section. The knitting machine, as it was in knitting the front section is programmed to change needles selection and after knitting the single ply fabric of the back section, thus returning to the beginning of the back section. Because the knitting machine is programmed to return to the beginning of the back section a portion of the single ply fabric is brought back over itself to the beginning of back section, as illustrated in FIGS. 7. This forms a two-ply back section 16 approximatley 1 inch long thus completing the cuff.

The back section therefore has a finished edge which facilitates attachment to a garment, for example a surgical gown.

Figure 8:
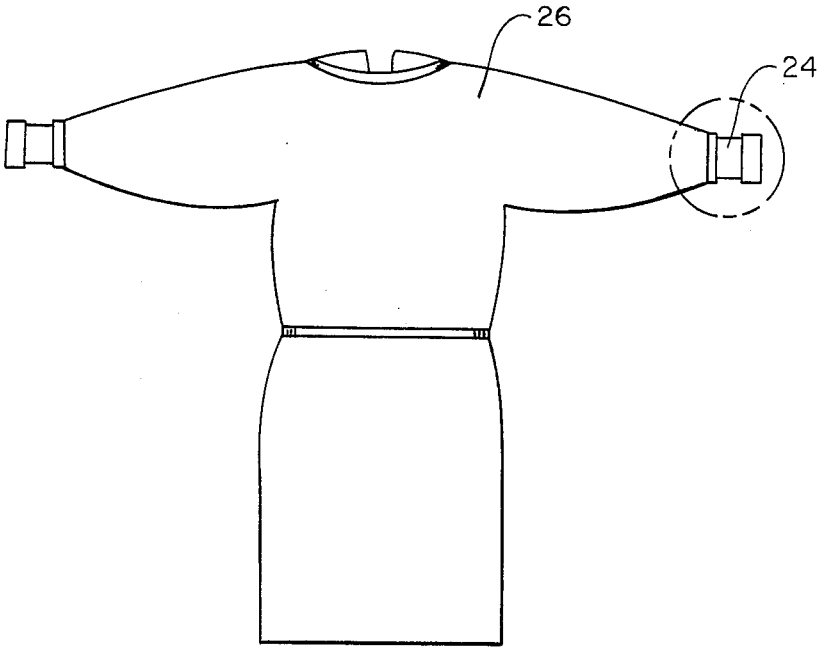
FIG. 8 is a view illustrating the present invention attached to a sleeve.

Attachment of a cuff 24 to a garment such as a surgical gown 26 is shown in FIG. 8.

Figure 9:
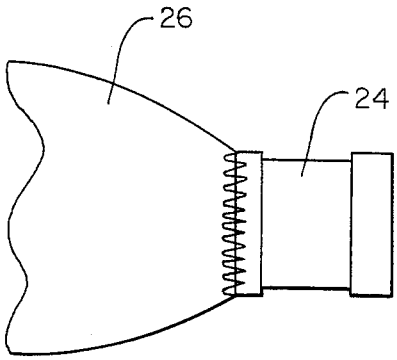
FIG. 9 is an expanded view of FIG. 8 to further illustrate the attachment of the present invention to a gown.

FIG. 9 an expanded view of FIG. 8 is used to further illustrate the attachment of a cuff 24 to a surgical gown 26.

This example is not intended to limit the present invention in any way except as to the following claims.

What is claimed is:

1. A circular knit garment cuff for use on surgical gowns comprising:

a two ply front section;

a single ply middle section ; and a two ply back section;

said front section being knit with two stretchable yarns, said middle section being knit with a stretchable yarn, and said back section being knit with a stretchable yarn, said front section, said middle section and said back section being continuously knit together so as to form a single integral garment cuff for securing to a garment material.

* * * * *